US010415835B2

(12) United States Patent
Billman et al.

(10) Patent No.: US 10,415,835 B2
(45) Date of Patent: Sep. 17, 2019

(54) GAS RANGE APPLIANCE WITH A GRIDDLE

(71) Applicant: Haier US Appliance Solutions, Inc., Wilmington, DE (US)

(72) Inventors: David William Billman, Louisville, KY (US); Joshua Adam Mayne, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 272 days.

(21) Appl. No.: 15/442,750

(22) Filed: Feb. 27, 2017

(65) Prior Publication Data

US 2018/0245799 A1 Aug. 30, 2018

(51) Int. Cl.
*F24C 15/10* (2006.01)
*F24C 15/20* (2006.01)

(52) U.S. Cl.
CPC ..... *F24C 15/107* (2013.01); *F24C 15/2007* (2013.01)

(58) Field of Classification Search
CPC .... F24C 15/107; F24C 15/2007; A47J 37/067
See application file for complete search history.

(56) References Cited

U.S. PATENT DOCUMENTS 2,274,299 A * 2/1942 Mayer ..... F24C 15/001 126/214 B
2008/0060634 A1* 3/2008 Blum ..... A47J 37/067 126/369
2012/0318256 A1* 12/2012 Chilton ..... A47J 37/0682 126/39 H
2014/0096761 A1* 4/2014 Brantley ..... F24C 15/12 126/39 M
2015/0075513 A1* 3/2015 Paller ..... F24C 15/006 126/198
2015/0260415 A1* 9/2015 Chadwick ..... F24C 15/006 126/21 R
2015/0323196 A1 11/2015 Chadwick et al.
2018/0003389 A1* 1/2018 Trice ..... F24C 3/082

FOREIGN PATENT DOCUMENTS

JP H02275223 A 11/1990

* cited by examiner

*Primary Examiner* — Avinash A Savani
*Assistant Examiner* — Aaron H Heyamoto
(74) *Attorney, Agent, or Firm* — Dority & Manning, P.A.

(57) ABSTRACT

A gas range appliance includes a griddle positioned on a top panel. The griddle has a cooking plate positioned over a gas burner. A first flange extends from the cooking plate towards a rear portion of a cabinet such that the first flange extends over an exit of an exhaust duct. A second flange extends from the cooking plate towards the top panel. The second flange is positioned between the gas burner and the first flange below the cooking plate.

15 Claims, 5 Drawing Sheets

GAS RANGE APPLIANCE WITH A GRIDDLE

FIELD OF THE INVENTION

The present subject matter relates generally to gas cooktop appliances, such as range appliances, with griddles.

BACKGROUND OF THE INVENTION

Range appliances generally include a cooktop portion and an oven portion. The cooktop portion of certain range appliances includes gas burners for heating cookware, such as griddles. Recently, gas cooktop appliances with integrated griddles have become popular. Integrated griddles on gas cooktop appliances are positioned over a gas burner and are heated by combustion of gaseous fuel and air at the gas burner.

Providing an integrated griddle can have drawbacks. For example, the integrated griddles can be positioned adjacent an exhaust duct of the oven portion, and the integrated griddles can direct air from the exhaust duct towards a wall behind the range appliance. In addition, heated air from below the integrated griddles can flow from the integrated griddles and impinge against the wall behind the range appliance.

Accordingly, a gas cooktop appliance with features for directing air from an exhaust duct away from a wall behind the gas cooktop appliance would be useful. In addition, a gas cooktop appliance with features for directing heated air from below a griddle away from a wall behind the gas cooktop appliance would be useful.

BRIEF DESCRIPTION OF THE INVENTION

The present subject matter provides a gas range appliance with a griddle positioned on a top panel. The griddle includes a cooking plate positioned over a gas burner. A first flange extends from the cooking plate towards a rear portion of a cabinet such that the first flange extends over an exit of an exhaust duct. A second flange extends from the cooking plate towards the top panel. The second flange is positioned between the gas burner and the first flange below the cooking plate. Additional aspects and advantages of the invention will be set forth in part in the following description, or may be apparent from the description, or may be learned through practice of the invention.

In a first exemplary embodiment, a gas range appliance is provided. The gas range appliance includes a cabinet that defines a cooking chamber. A door is mounted to the cabinet at a front portion of the cabinet. A gas burner is positioned over the cooking chamber. The gas burner is positioned on a top panel of the cabinet. An exhaust duct is positioned within the cabinet. The exhaust duct extends between an entrance and an exit. The entrance of the exhaust duct is positioned at the cooking chamber. The exit of the exhaust duct is positioned at the top panel proximate a rear portion of the cabinet. A griddle is positioned on the top panel. The griddle includes a cooking plate positioned over the gas burner. A first flange extends from the cooking plate towards the rear portion of the cabinet such that the first flange extends over the exit of the exhaust duct. A second flange extends from the cooking plate towards the top panel. The second flange is positioned between the gas burner and the first flange below the cooking plate.

In a second exemplary embodiment, a gas range appliance is provided. The gas range appliance includes a cabinet that defines a cooking chamber. The cabinet extends between a front portion and a rear portion along a transverse direction. The cabinet also extends between a top portion and a bottom portion along a vertical direction that is perpendicular to the transverse direction. The cabinet has a top panel at the top portion of the cabinet. A gas burner is positioned at the top panel. The gas burner is positioned over the cooking chamber along the vertical direction. An exhaust duct is positioned within the cabinet. The exhaust duct extends between an entrance and an exit. The entrance of the exhaust duct is positioned at the cooking chamber. The exit of the exhaust duct is positioned at the top panel proximate the rear portion of the cabinet. A griddle is positionable on the top panel. The griddle includes a cooking plate positioned over the gas burner when the griddle is positioned on the top panel. A first flange extends from the cooking plate outwardly along the transverse direction towards the rear portion of the cabinet such that the first flange extends over the exit of the exhaust duct when the griddle is positioned on the top panel. A second flange extends from the cooking plate downwardly along the vertical direction towards the top panel when the griddle is positioned on the top panel. The second flange is positioned between the gas burner and the first flange along the transverse direction when the griddle is positioned on the top panel.

In a third exemplary embodiment, a gas range appliance is provided. The gas range appliance includes a cabinet that defines a cooking chamber. A door is mounted to the cabinet at a front portion of the cabinet. A gas burner is positioned over the cooking chamber. The gas burner is positioned on a top panel of the cabinet. An exhaust duct is positioned within the cabinet. The exhaust duct extends between an entrance and an exit. The entrance of the exhaust duct is positioned at the cooking chamber. The exit of the exhaust duct is positioned at the top panel proximate a rear portion of the cabinet. A griddle is positioned on the top panel. The griddle includes a cooking plate positioned over the gas burner. The griddle also includes one or more of a first flange and a second flange. The first flange extends from the cooking plate towards the rear portion of the cabinet such that the first flange extends over the exit of the exhaust duct. The second flange extends from the cooking plate towards the top panel. The second flange is positioned between the gas burner and the first flange below the cooking plate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
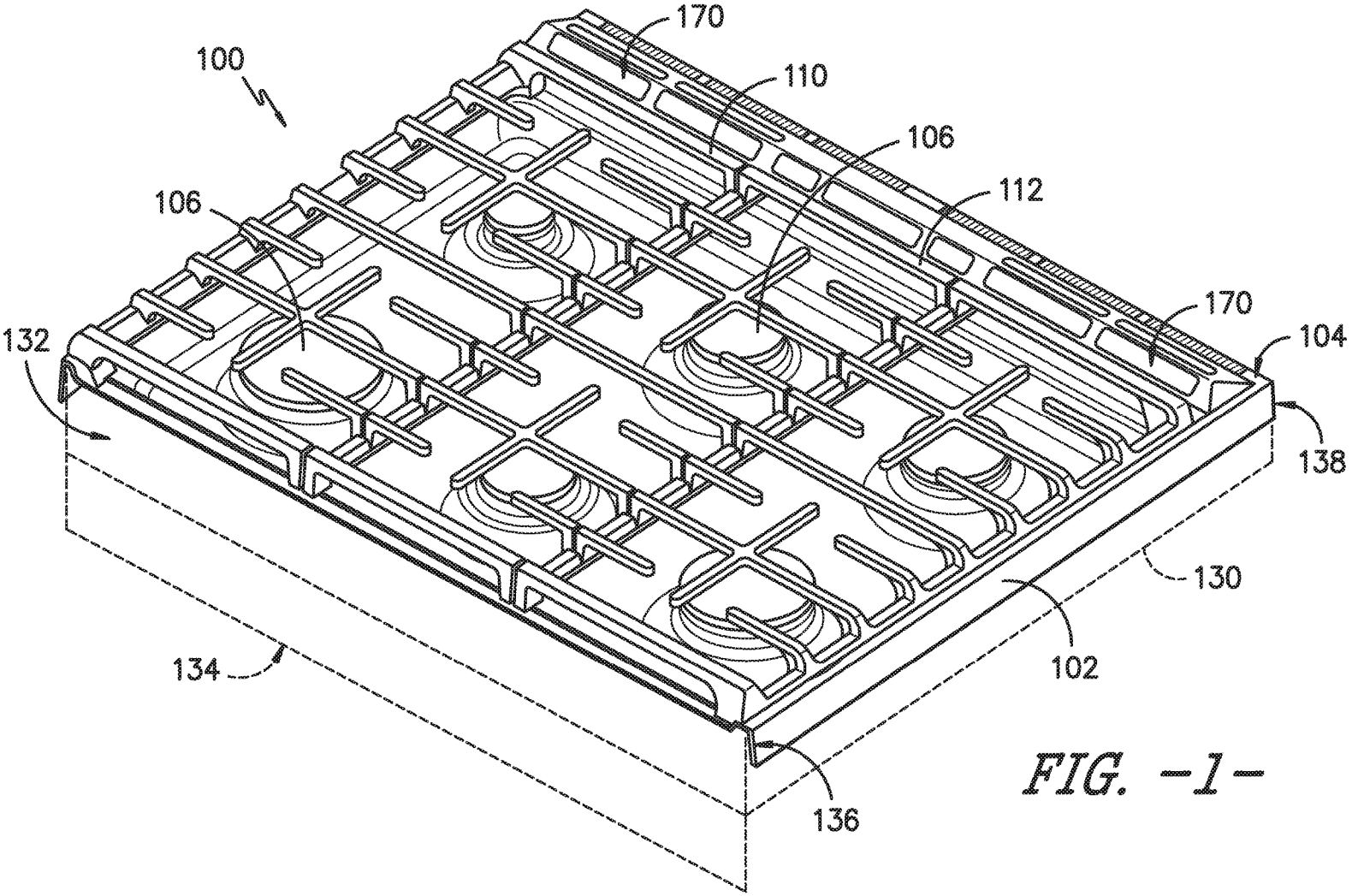
FIG. 1 provides a perspective view of a cooktop appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
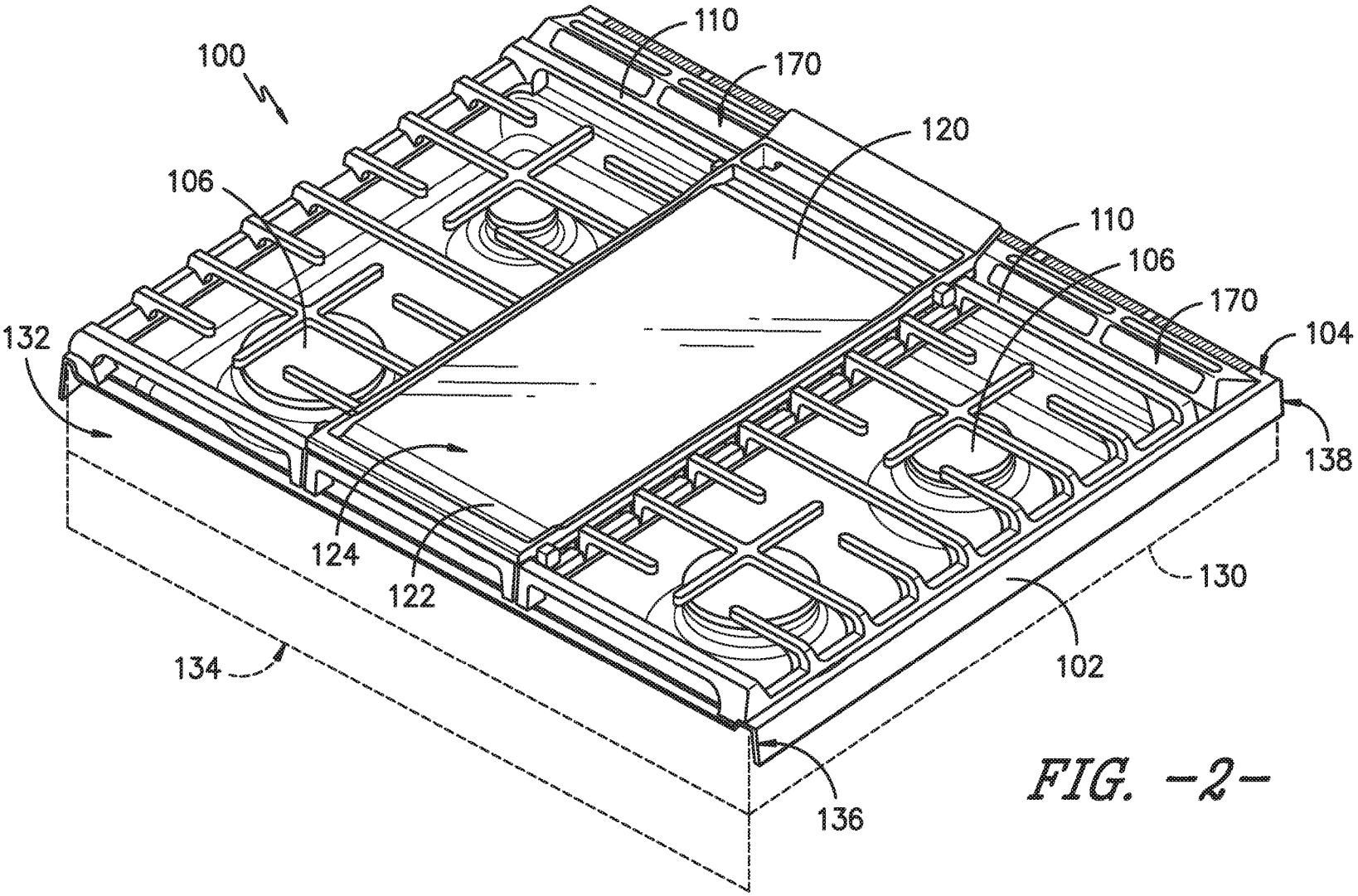
FIG. 2 provides a perspective view of the exemplary cooktop appliance of FIG. 1 with a griddle positioned on a top panel of the exemplary cooktop appliance.

FIGS. 1 and 2 provide perspective views of a cooktop appliance 100 according to an exemplary embodiment of the present subject matter with cooktop appliance 100 shown in various configurations. In FIG. 1, cooktop appliance 100 is shown in a gas burner cooking configuration, and cooktop appliance 100 is shown in a griddle cooking configuration in FIG. 2. A user may selectively adjust cooktop appliance 100 between the gas burner cooking configuration of FIG. 1 and the griddle cooking configuration in FIG. 2, as discussed in greater detail below.

Cooktop appliance 100 may be installed at any suitable location. For example, cooktop appliance 100 may be utilized in a range appliance. While described in greater detail below in the context of cooktop appliance 100, it should be understood that the present subject matter may be used in any other suitable cooktop appliance in alternative exemplary embodiments. Thus, cooktop appliance 100 is provided by way of example only and is not intended to limit the present subject matter to any particular gas burner arrangement.

As may be seen in FIGS. 1 and 2, cooktop appliance 100 includes top panel 102 with an outer surface 104. Top panel 102 may be constructed of or with any suitable material. For example, top panel 102 may be constructed of or with stainless steel, enameled steel or ceramic. Top panel 102 may also have any suitable shape. For example, top panel 102 may be rectangular, e.g., in a plane that is perpendicular to a vertical direction V.

A plurality of gas burners 106 is mounted to top panel 102 and is positioned at outer surface 104 of top panel 102. Each gas burner of gas burners 106 may have any suitable shape and size, and a combination of variously sized and/or shaped gas burners 106 may be provided in order to facilitate heating of a variety of cooking utensils. For example, as shown in FIG. 1, gas burners 106 may be circular and have various diameters.

A plurality of grates 110 is also positioned on top panel 102 at outer surface 104 of top panel 102 over gas burners 106. Grates 110 are configured for supporting cooking utensils, such as pots, pans, etc., over gas burners 106, and gas burners 106 are configured for combusting gaseous fuel and air in order to heat cooking utensils on grates 110. As shown in FIG. 1, grates 110 include a first grate 112 (or pair of grates). First grate 112 is configured to be positioned on top panel 102 over the set of gas burners 106 in the gas burner cooking configuration. Grates 110, including first grate 112, are removable from top panel 102. For example, a user of cooktop appliance 100 may lift grates 110 upwardly to remove grates 110 from top panel 102.

As discussed above, the present subject matter may be used in or with range appliances. As an example, the present subject matter may be used in or with the range appliance described in U.S. Patent Application Publication No. 2016/0033139 A1 of Paul Bryan Cadima, the oven range appliance described in U.S. Patent Application Publication No. 2015/0075513 A1 of Hans Juergen Paller and/or the appliance described in U.S. Patent Application Publication No. 2013/0025582 A1 of Paul Bryan Cadima, the contents of each above referenced publication is incorporated by reference in its entirety. Various range appliance features are illustrated schematically in FIGS. 1 and 2. Thus, cooktop appliance 100 may include a cabinet 130 with a cooking chamber 132 and a door 134. Door 134 is mounted to cabinet 130 at a front portion 136 of cabinet 130. Door 134 may be opened and closed to allow access to cooking chamber 132. Top panel 102 and gas burners 106 may be positioned above cooking chamber 132 on cabinet 130.

Turning to FIG. 2, cooktop appliance 100 also includes a griddle assembly 120. Griddle assembly 120 is configured to be positioned on top panel 102 over a set of gas burners 106 in the griddle cooking configuration. Thus, like first grate 112, griddle assembly 120 is removable from top panel 102. In particular, first grate 112 and griddle assembly 120 may be interchangeable on top panel 102. Thus, a user may shift cooktop appliance 100 from the gas burner cooking configuration shown in FIG. 1 to the griddle cooking configuration shown in FIG. 2 by removing first grate 112 from top panel 102 and placing griddle assembly 120 on top panel 102 over the set of gas burners 106.

Griddle assembly 120 may be positioned over any suitable number of gas burners 106 when cooktop appliance 100 is in the griddle cooking configuration. For example, as discussed above, griddle assembly 120 is positioned over the set of gas burners 106 in the griddle cooking configuration. Thus, griddle assembly 120 is positioned over at least one gas burner in the griddle cooking configuration. In alternative exemplary embodiments, griddle assembly 120 may be positioned over at least two gas burners, at least three gas burners, at least four gas burners, etc. in the griddle cooking configuration. As shown in FIG. 2, griddle assembly 120 is not positioned over all gas burners of gas burners 106 when cooktop appliance 100 is in the griddle cooking configuration, in certain exemplary embodiments. Thus, some of gas burners 106 may be accessible and operable under grates 110 when cooktop appliance 100 is in the griddle cooking configuration.

As may be seen in FIG. 2, griddle assembly 120 includes a cooking or griddle plate 122 with a cooking surface 124. Cooking surface 124 is configured for supporting food items thereon during cooking of such food items with griddle assembly 120. Griddle plate 122 may have any suitable shape. For example, griddle plate 122 may be rectangular or square, e.g., in a plane that is perpendicular to the vertical direction V. Griddle assembly 120 is discussed in greater detail below in the context of FIGS. 3 through 7.

Figure 3:
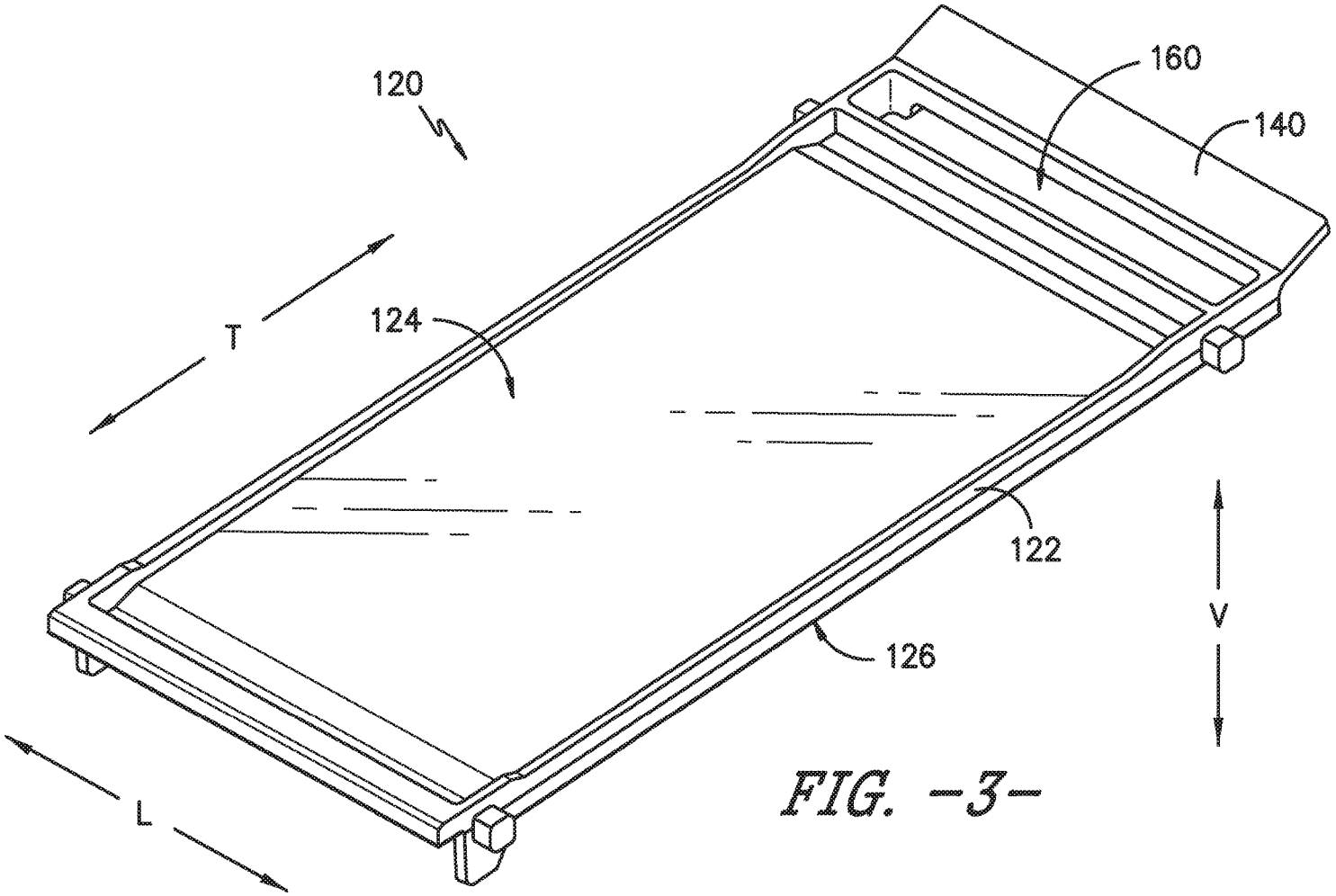
FIG. 3 provides a top, perspective view of the griddle of FIG. 2.
Figure 4:
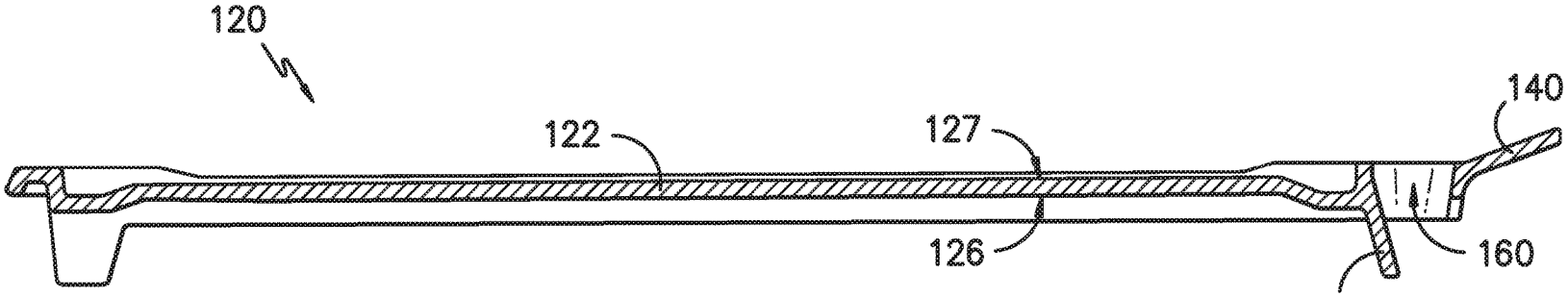
FIG. 4 provides a side, section view of the griddle of FIG. 2.
Figure 5:
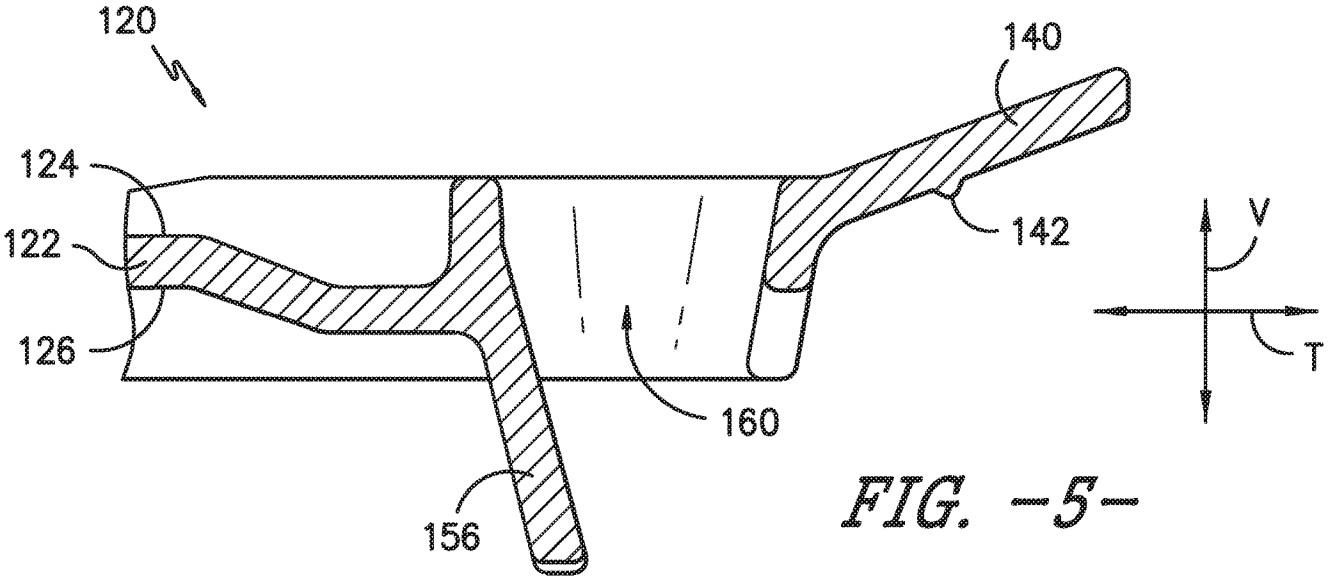
FIG. 5 provides a section view of an exhaust conduit of the griddle of FIG. 2.
Figure 6:
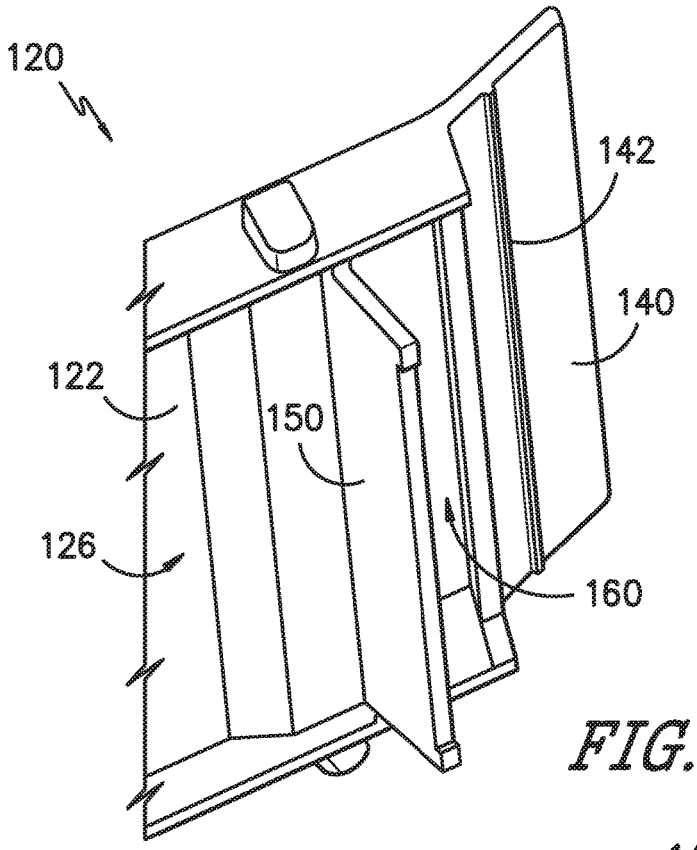
FIG. 6 provides a partial, bottom perspective view of the griddle of FIG. 2.
Figure 7:
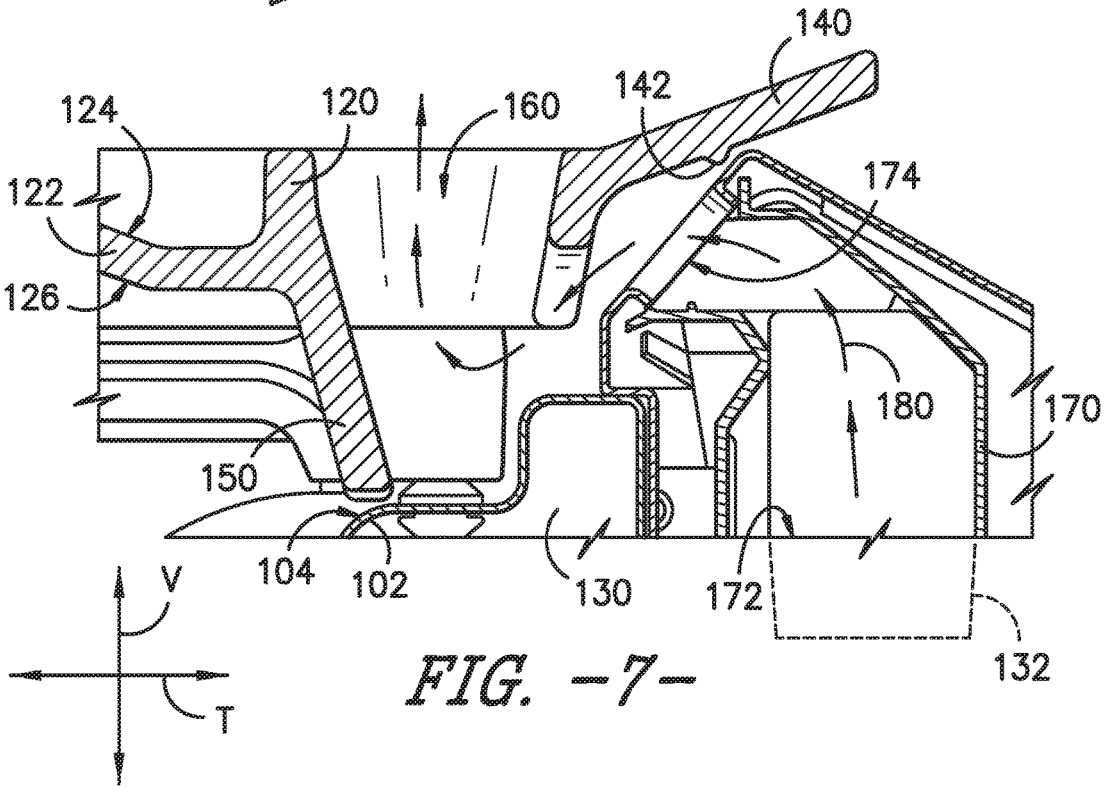
FIG. 7 provides a section view of an exhaust air flow path of the exemplary cooktop appliance of FIG. 2 through the griddle of the exemplary cooktop appliance.

FIG. 3 provides a top, perspective view of griddle assembly 120. FIG. 4 provides a side, section view of griddle assembly 120. FIG. 5 provides a section view of an exhaust conduit 160 of griddle assembly 120. FIG. 6 provides a partial, bottom perspective view of griddle assembly 120. FIG. 7 provides a section view of an exhaust air flow path 180 of cooktop appliance 100 through griddle assembly 120. Griddle assembly 120 defines a vertical direction V, a lateral direction L and a transverse direction T that are mutually perpendicular and form an orthogonal direction system. As discussed in greater detail below, griddle assembly 120 includes features for diverting air from below griddle assembly 120 away from a wall behind cooktop appliance 100.

As may be seen in FIG. 7, cooktop appliance 100 includes an exhaust duct 170. Exhaust duct 170 is positioned within cabinet 130 and is configured for directing air from cooking chamber 132 out of cabinet 130. For example, exhaust duct 170 extends between an entrance 172 and an exit 174. Entrance 172 of exhaust duct 170 is positioned at cooking chamber 132, and exhaust duct 170 may be contiguous with cooking chamber 132 at entrance 172 of exhaust duct 170 such that air from cooking chamber 132 may flow from cooking chamber 132 into exhaust duct 170 at entrance 172 of exhaust duct 170. Exit 174 of exhaust duct 170 may be positioned at top panel 102 proximate a rear portion 138 of cabinet 130, and exhaust duct 170 may be contiguous with ambient air about cooktop appliance 100 at exit 174 of exhaust duct 170 such that air from cooking chamber 132 may flow from exhaust duct 170 into ambient air about cooktop appliance 100 at exit 174 of exhaust duct 170. Exit 174 of exhaust duct 170 may be positioned above gas burners 106 along the vertical direction V.

Griddle assembly 120 includes features for diverting air from exit 174 of exhaust duct 170 away from a wall behind cooktop appliance 100. As may be seen in FIGS. 4 through 7, griddle assembly 120 includes a first wall or flange 140 and a second wall or flange 150. First flange 140 extends from griddle plate 122, e.g., along the transverse direction T, towards rear portion 138 of cabinet 130 when griddle assembly 120 is positioned on top panel 102. Thus, first flange 140 may extend away from griddle plate 122 along the transverse direction T such that first flange 140 extends over exit 174 of exhaust duct 170. In such a manner, first flange 140 is positioned and oriented to direct a flow of air from exit 174 of exhaust duct 170 towards front portion 136 of cabinet 130, e.g., along the transverse direction T, and away from a wall behind cooktop appliance 100 at rear portion 138 of cabinet 130. First flange 140 may also extend along the lateral direction L by about a width of the griddle plate 122 along the lateral direction L. Thus, griddle plate 122 and first flange 140 may have a common width along the lateral direction L. As used herein, the term "about" means within three inches of the stated width when used in the context of widths.

Second flange 150 extends from griddle plate 122, e.g., bottom surface 126 of griddle plate 122, towards top panel 102 when griddle assembly 120 is positioned on top panel 102. Thus, second flange 150 may extend downwardly along the vertical direction V from griddle plate 122. For example, second flange 150 may extend downwardly along the vertical direction V from griddle plate 122 such that second flange 150 contacts or rests on top panel 102. As another example, second flange 150 may be spaced from top panel 102 by a gap along the vertical direction V when griddle assembly 120 is positioned on top panel 102. The gap between second flange 150 and top panel 102 along the vertical direction V may be no greater than a quarter of an inch (0.25") or an eighth of an inch (0.125") in certain exemplary embodiments.

Second flange 150 may be positioned between one of gas burners 106 and first flange 140, e.g., along the transverse direction T, below griddle plate 122. In such a manner, second flange 150 is positioned and oriented to block the flow of air from exit 174 of exhaust duct 170 from flowing below griddle plate 122 towards gas burners 106, e.g., along the transverse direction T. Second flange 150 may thus block air from exit 174 of exhaust duct 170 from interfering with lighting of or flames at gas burners 106. Second flange 150 may also extend along the lateral direction L by about the width of the griddle plate 122 along the lateral direction L. Thus, griddle plate 122 and second flange 150 may have a common width along the lateral direction L.

As may be seen in FIG. 7, exit 174 of exhaust duct 170 may be positioned higher than top panel 102. First flange 140 may extend upwardly along the vertical direction V from griddle plate 122 over exit 174 of exhaust duct 170. For example, first flange 140 may extend from griddle plate 122 such that first flange 140 is angled at about thirty degrees (30°) relative to horizontal. As used herein, the term "about" means within ten degrees of the stated angle when used in the context of angles. First flange 140 may also extend from griddle plate 122 past exit 174 of exhaust duct 170 along the transverse direction T. First flange 140 may also extend from griddle plate 122 past exit 174 of exhaust duct 170 by no less than half an inch and no more than three inches along the transverse direction T, in certain exemplary embodiments. A lip 142 on first flange 140 may extend downwardly along the vertical direction V from first flange 140 towards exit 174 of exhaust duct 170. Lip 142 may reduce a gap between first flange 140 and exit 174 of exhaust duct 170 along the vertical direction and thereby assist with blocking air from exit 174 of exhaust duct 170 from passing under first flange 140 towards a wall behind cooktop appliance 100 at rear portion 138 of cabinet 130. Lip 142 may be spaced from exit 174 of exhaust duct 170, another component of cabinet 130 or top panel 102 along the vertical direction V may be no greater than a quarter of an inch (0.25") or an eighth of an inch (0.125") in certain exemplary embodiments.

Griddle assembly 120 also defines an exhaust conduit 160 that extends through griddle plate 122 along the vertical direction V. Exhaust conduit 160 may be positioned between first flange 140 and second flange 150, e.g., along the transverse direction T. Collectively, first flange 140, second flange 150 and exhaust conduit 160 may assist with forming or defining the exhaust air flow path 180. The exhaust air flow path 180 is shown with arrows in FIG. 7 and corresponds to a flow path cooking chamber 132 flue gases from exit 174 of exhaust duct 170 through griddle assembly 120 away from a wall behind cooktop appliance 100. In particular, first flange 140 is positioned and oriented to direct a flow of flue gases from exit 174 of exhaust duct 170 towards exhaust conduit 160. Second flange 150 may be positioned and oriented for blocking the flow of flue gases from flowing beneath griddle plate 122. Thus, first and second flanges 140, 150 may be positioned and oriented for directing the flow of flue gases from exit 174 of exhaust duct 170 to exhaust conduit 160, and exhaust conduit 160 may guide the flow of flue gases through griddle plate 122 and away from a wall behind cooktop appliance 100. In such a manner, the exhaust air flow path 180 through griddle assembly 120 may assist with reducing impingement of heated air against a wall behind cooktop appliance 100 relative to griddles without first flange 140, second flange 150 and/or exhaust duct 170.

Griddle assembly 120 may be formed in any suitable manner. For example, griddle plate 122, first flange 140 and second flange 150 may be separate pieces of metal mounted to one another to form griddle assembly 120. As another example, griddle assembly 120 may be cast such that griddle plate 122, first flange 140 and second flange 150 are a single piece of metal, such as cast iron or aluminum. Thus, griddle plate 122, first flange 140 and second flange 150 may be integral or seamless with one another.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas range appliance, comprising:

a cabinet defining a cooking chamber;

a door mounted to the cabinet at a front portion of the cabinet;

a gas burner positioned over the cooking chamber, the gas burner positioned on a top panel of the cabinet;

an exhaust duct positioned within the cabinet, the exhaust duct extending between an entrance and an exit, the entrance of the exhaust duct positioned at the cooking chamber, the exit of the exhaust duct positioned at the top panel proximate a rear portion of the cabinet;

a griddle positioned on the top panel, the griddle comprising a cooking plate positioned over the gas burner;

a first flange extending from the cooking plate towards the rear portion of the cabinet such that the first flange extends over the exit of the exhaust duct; and a second flange extending from the cooking plate towards the top panel, the second flange positioned between the gas burner and the first flange below the cooking plate, wherein the exit of the exhaust duct is positioned higher than the top panel of the cabinet, the first flange extending upwardly from the cooking plate over the exit of the exhaust duct, and wherein the first flange extends from the griddle plate past the exit of the exhaust duct by no less than half an inch and no more than three inches.

2. The gas range appliance of claim 1, wherein the griddle is cast such that the cooking plate, the first flange and the second flange are a single piece of metal.

3. The gas range appliance of claim 2, wherein the single piece of metal comprises cast iron or aluminum.

4. The gas range appliance of claim 1, wherein the griddle defines an exhaust conduit that extends through the griddle, the exhaust conduit positioned between the first flange and the second flange.

5. The gas range appliance of claim 4, wherein the first flange is positioned and oriented to direct a flow of air from the exit of the exhaust duct towards the exhaust conduit.

6. The gas range appliance of claim 5, wherein the second flange is positioned and oriented for blocking the flow of air from flowing beneath the cooking plate.

7. The gas range appliance of claim 1, wherein a lip on the first flange extends downwardly from the first flange towards the exit of the exhaust duct.

8. The gas range appliance of claim 1, wherein the first flange is positioned and oriented to direct a flow of air from the exit of the exhaust duct towards the front portion of the cabinet.

9. A gas range appliance, comprising:

a cabinet defining a cooking chamber, the cabinet extending between a front portion and a rear portion along a transverse direction, the cabinet also extending between a top portion and a bottom portion along a vertical direction that is perpendicular to the transverse direction, the cabinet having a top panel at the top portion of the cabinet;

a gas burner positioned at the top panel, the gas burner positioned over the cooking chamber along the vertical direction;

an exhaust duct positioned within the cabinet, the exhaust duct extending between an entrance and an exit, the entrance of the exhaust duct positioned at the cooking chamber, the exit of the exhaust duct positioned at the top panel proximate the rear portion of the cabinet;

a griddle positionable on the top panel, the griddle comprising a cooking plate positioned over the gas burner when the griddle is positioned on the top panel;

a first flange extending from the cooking plate outwardly along the transverse direction towards the rear portion of the cabinet such that the first flange extends over the exit of the exhaust duct when the griddle is positioned on the top panel; and a second flange extending from the cooking plate downwardly along the vertical direction towards the top panel when the griddle is positioned on the top panel, the second flange positioned between the gas burner and the first flange along the transverse direction when the griddle is positioned on the top panel, wherein the exit of the exhaust duct is positioned higher than the top panel of the cabinet along the vertical direction, the first flange extending upwardly along the vertical direction from the cooking plate over the exit of the exhaust duct when the griddle is positioned on the top panel, and wherein the first flange extends from the griddle plate past the exit of the exhaust duct by no less than half an inch and no more than three inches when the griddle is positioned on the top panel.

10. The gas range appliance of claim 9, wherein the griddle is cast such that the cooking plate, the first flange and the second flange are a single piece of metal.

11. The gas range appliance of claim 9, wherein the griddle defines an exhaust conduit that extends through the griddle along the vertical direction, the exhaust conduit positioned between the first flange and the second flange along the transverse direction when the griddle is positioned on the top panel.

12. The gas range appliance of claim 11, wherein the first flange is positioned and oriented to direct a flow of air from the exit of the exhaust duct towards the exhaust conduit when the griddle is positioned on the top panel.

13. The gas range appliance of claim 12, wherein the second flange is positioned and oriented for blocking the flow of air from flowing beneath the cooking plate when the griddle is positioned on the top panel.

14. The gas range appliance of claim 9, wherein a lip on the first flange extends downwardly along the vertical direction from the first flange towards the exit of the exhaust duct when the griddle is positioned on the top panel.

15. The gas range appliance of claim 9, wherein the first flange is positioned and oriented to direct a flow of air from the exit of the exhaust duct towards the front portion of the cabinet when the griddle is positioned on the top panel.

* * * * *